US010098418B1

(12) United States Patent
Chang

(10) Patent No.: US 10,098,418 B1
(45) Date of Patent: Oct. 16, 2018

(54) BUCKLE CAPABLE OF FIXING FOLDED STRAP

(71) Applicant: Teng-Yao Chang, Taichung (TW)

(72) Inventor: Teng-Yao Chang, Taichung (TW)

( * ) Notice: Subject to any disclaimer, the term of this patent is extended or adjusted under 35 U.S.C. 154(b) by 0 days.

(21) Appl. No.: 15/650,513

(22) Filed: Jul. 14, 2017

(30) Foreign Application Priority Data

Apr. 12, 2017 (TW) ..... 106112200 A

(51) Int. Cl.
*A44B 11/25* (2006.01)
*A45F 3/04* (2006.01)

(52) U.S. Cl.
CPC ..... *A44B 11/2557* (2013.01); *A45F 3/047* (2013.01); *A44D 2200/10* (2013.01)

(58) Field of Classification Search
CPC ..... A44C 11/2557; A45F 3/047
See application file for complete search history.

(56) References Cited

U.S. PATENT DOCUMENTS

| | | | | |
|---|---|---|---|---|
| 2,005,569 | A * | 6/1935 | Smith | A41F 15/02 12/142 D |
| 2012/0325164 | A1* | 12/2012 | Finlan | A01K 27/001 119/863 |
| 2013/0232743 | A1* | 9/2013 | Takazakura | A44B 11/266 24/625 |
| 2016/0219986 | A1* | 8/2016 | Fiedler | A44B 11/008 |

FOREIGN PATENT DOCUMENTS

| | | | |
|---|---|---|---|
| TW | M243965 | U | 9/2004 |
| TW | 200744498 | A | 12/2007 |
| TW | M465795 | U | 11/2013 |

OTHER PUBLICATIONS

Examination Report for TW106112200, dated Jun. 20, 2017, Total of 6 pages.
Search Report for TW106112200, dated Jun. 20, 2017, Total of 1 page.
English Abstract for TW200744498 (A), Total of 1 page.
English Abstract for corresponding document: EP1186251 (A1) for TWM243965 (U), Total of 1 page.
English Abstract for TWM465795 (U), Total of 1 page.

* cited by examiner

*Primary Examiner* — David M Upchurch
(74) *Attorney, Agent, or Firm* — Lynette Wylie; Apex Juris, Pllc.

(57) ABSTRACT

A buckle capable of fixing a folded strap is disclosed, which includes a first buckle member, a second buckle member, and a string. The first connecting portion has a first connecting portion and a first buckling portion, and is adapted to be connected to a strap. The second buckle member has a second connecting portion, a second buckling portion, and an engaging portion, and is adapted to be connected to the strap or another strap. The second buckling portion is adapted to be detachably engaged with the first buckling portion. The string is provided on the engaging portion, and is adapted to fix the strap or the another strap. Said buckle could be applied with any kind of straps, such as belts, straps of a backpack, or waistbands. After the strap is adjusted, a superfluous section of the strap could be folded and then fixed by the string.

9 Claims, 10 Drawing Sheets

BUCKLE CAPABLE OF FIXING FOLDED STRAP

BACKGROUND OF THE INVENTION

1. Technical Field

The present invention relates to a buckle, and more particularly to a buckle which is capable of fixing a folded strap.

2. Description of Related Art

Buckles are widely used to connect two loose ends of long objects such as belts, waistbands, straps of backpacks, etc. However, a superfluous section may be left at where two loose ends are connected. Such a superfluous section would provide no specific functions, and therefore is apparently redundant. In light of this, how to neatly arrange the superfluous section has long been a problem to be solved in the industry.

Take a backpack 1 shown in FIG. 1 as an example. A strap of the conventional backpack 1 is composed of a shoulder strap 2, an adjusting strap 3, and a buckle 4. A side of the buckle 4 is connected to the shoulder strap 2, while another side thereof is passed through by the adjusting strap 3. Whereby, the shoulder strap 2, the adjusting strap 3, and the buckle 4 form an enclosed structure, through which the backpack 1 can be carried. A part of the adjusting strap 3 usually extends out of the buckle 4 and becomes a superfluous section 5 (or can be called an adjusted section). The superfluous section 5 is almost an inevitable product after adjusting the perimeter of the enclosed structure of the strap. However, the length of the superfluous section 5 differs depending on the body shape or usage habit of the user.

In some cases, the superfluous section 5 may be swayed or swung by shaking, and may hit others or the user his/herself. Furthermore, the superfluous section 5 may hook or entangle other objects, which is potentially dangerous. For example, if the superfluous section 5 is drawn into a machine, the user may be seriously injured or even killed. Let alone these potential risks, the superfluous section 5 does not look neat.

Therefore, a buckle capable of neatly arranging the strap is expected to be welcomed in the market.

BRIEF SUMMARY OF THE INVENTION

In view of the above, the primary objective of the present invention is to provide a buckle, which could neatly fix a folded strap.

To achieve the objective of the present invention, the present invention provides a buckle, which includes a first buckle member, a second buckle member, and a string. The first buckle member has a first connecting portion and a first buckling portion, wherein the first connecting portion is adapted to be connected to a strap. The second buckle member has a second connecting portion, a second buckling portion, and an engaging portion, wherein the second connecting portion is adapted to be connected to the strap or another strap, and the second buckling portion is adapted to be detachably engaged with the first buckling portion. The string is provided on the engaging portion, wherein the string is adapted to fix the strap or the another strap, which is folded.

With the aforementioned design, the folded strap could be neatly fixed on the buckle through the string which is provided on the engaging portion.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 2:
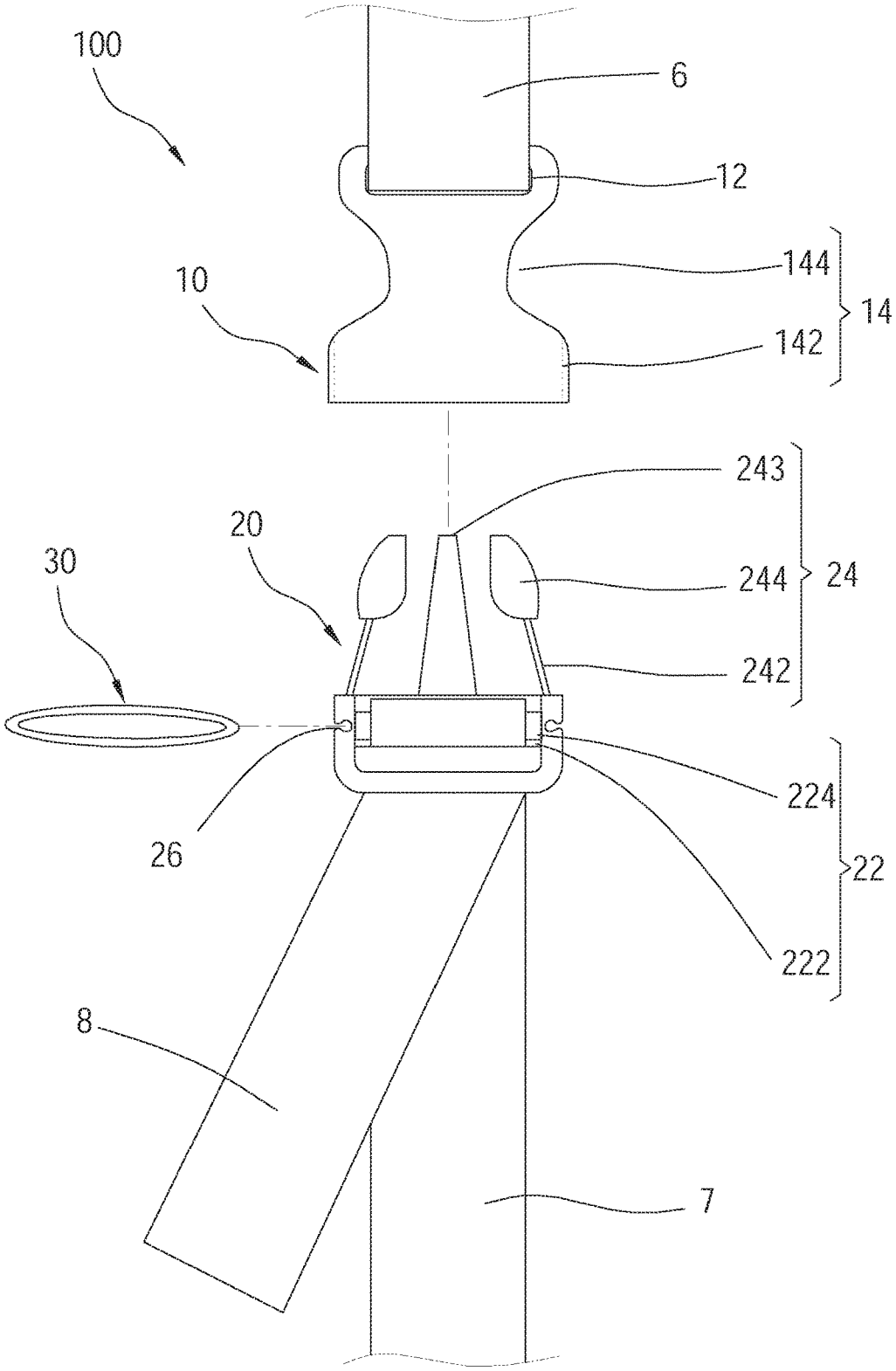
FIG. 2 is a perspective view of the buckle of a first embodiment of the present invention.
Figure 3:
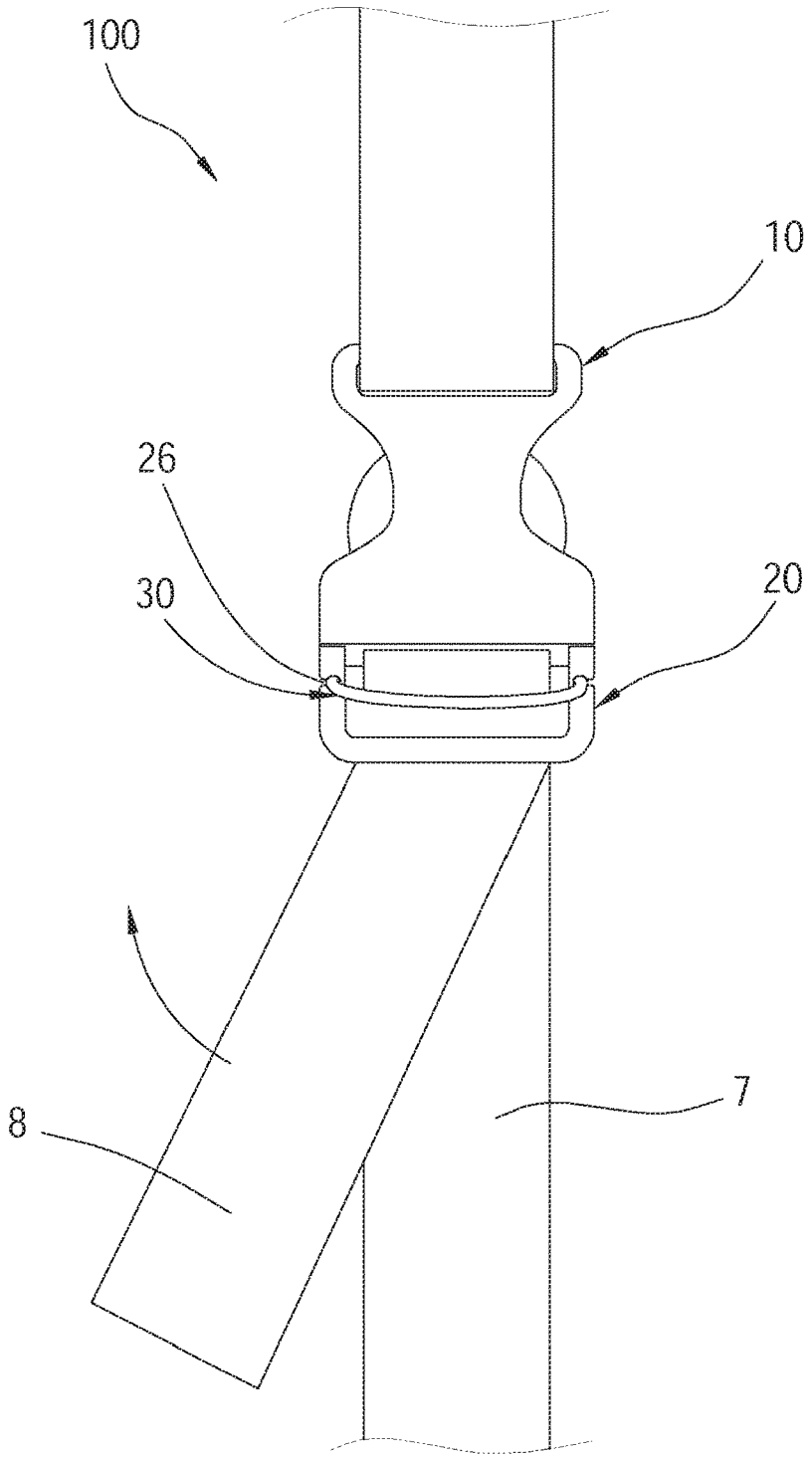
FIG. 3 is a perspective view of the buckle of the first embodiment, showing the string is engaged with the second buckle member.

As illustrated in FIG. 2 and FIG. 3, a buckle 100 of a first embodiment of the present invention, which could fold and fix a strap, includes a first buckle member 10, a second buckle member 20, and a string 30.

Figure 1:
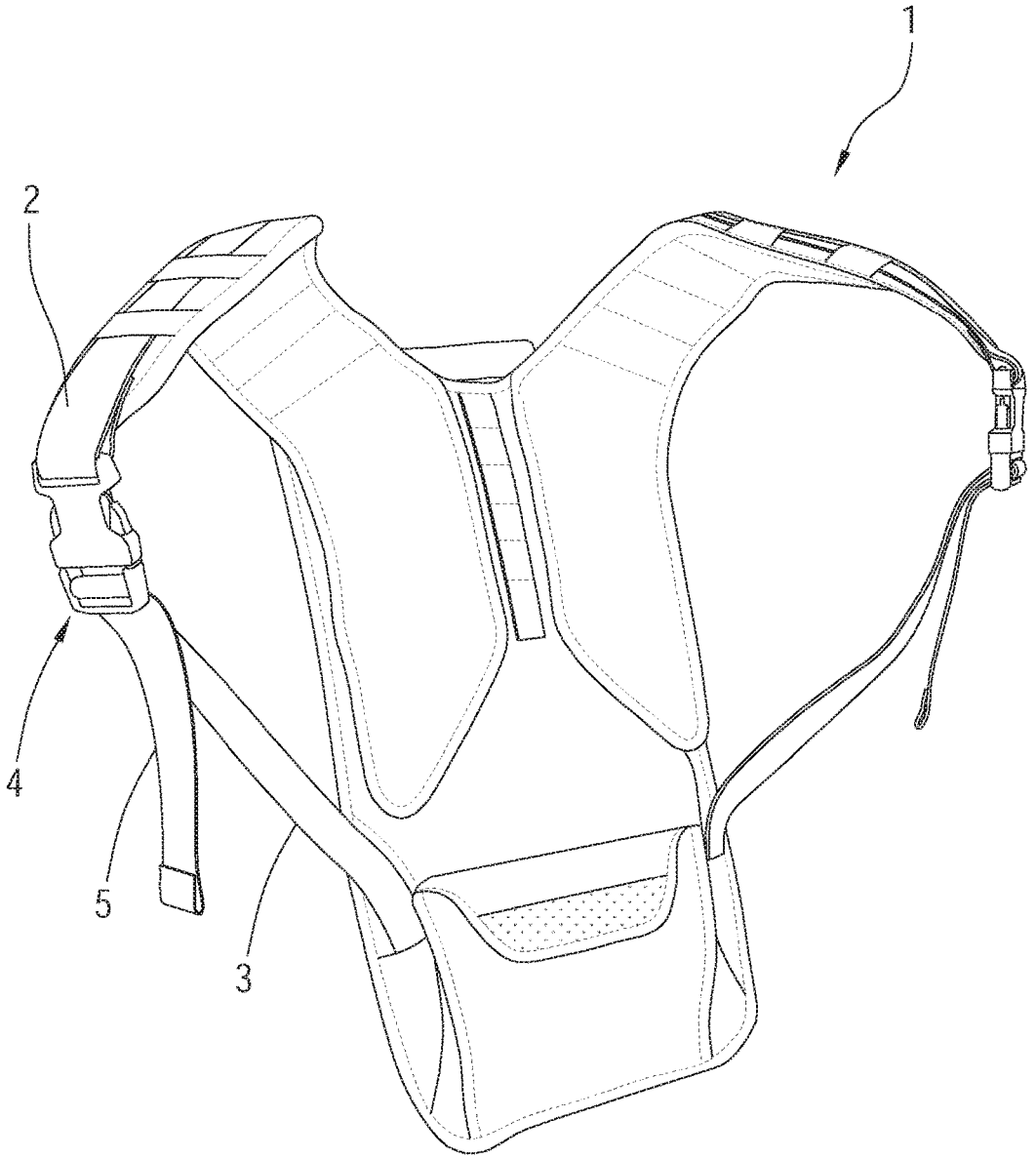
FIG. 1 (PRIOR ART)
FIG. 1 is a schematic view of a conventional backpack.

The first buckle member 10 is a female buckle member, and includes a first connecting portion 12 and a first buckling portion 14. The first connecting portion 12 is adapted to be connected to a strap 6. In the current embodiment, said first connecting portion 12 includes a slot, and said strap 6 can be equivalent, but not limited, to the shoulder strap 2 connected to the backpack 1 illustrated in FIG. 1. The strap 6 is provided passing through the slot to be connected to the first buckle member 10. In the current embodiment, the first buckling portion 14 includes a cavity 142 extending inward in a lower portion of the first buckle member 10, and two holes 144 forming on two lateral sides of the first buckle member 10.

Said second buckle member 20 is a male buckle member, and has a second connecting portion 22, a second buckling portion 24, and an engaging portion. The second connecting portion 22 is adapted to be connected to a strap 7, wherein said strap 7 can be equivalent, but not limited, to the adjusting strap 3 of the backpack 1. In the current embodiment, said second connecting portion 22 includes two slots 222 and a bar 224, wherein the slots 222 are parallel with an interval therebetween, and the bar 224 is located between the slots 222. The strap 7 is provided passing through the slots 222, and winding around the bar 224 to be movably positioned on the second connecting portion 22, wherein a length of the strap 7 extending out of the slots 222 could be adjusted as required. A part of the strap 7 which extends out of the slots 222 after being adjusted becomes a superfluous section 8.

Said second buckling portion 24 is adapted to be detachably engaged with the first buckling portion 14. In the current embodiment, the second buckling portion 24 includes two arms 242 and a supporting arm 243 located between the arms 242, wherein an end of each of the arms 242 has a projection 244. The second buckling portion 24 is adapted to fit into the cavity 142 of the first buckling portion 14, and the projection 244 of each of the arms 242 is respectively confined by a bottom edge of one of the holes 144, whereby to detachably engaging the second buckling portion 24 and the first buckling portion 14. The supporting arm 243 is adapted to abut against an inner wall of the cavity 142, whereby to provide a firm support after the first buckle member 10 is engaged with the second buckle member 20. In practice, the supporting arm 243 could be omitted.

Said engaging portion is adapted to have the string 30 provided thereon. In the current embodiment, the engaging portion includes two notches 26 respectively recessed into two lateral side surfaces of the second buckle member 20. As shown in FIG. 2, the notches 26 are respectively located at two ends of the bar 224.

The string 30 is provided on the engaging portion to fix the folded strap. More specifically, the string 30 is adapted to fix the superfluous section 8 of the folded strap 7. In the current embodiment, the string 30 is a flexible nylon loop fitting around the second buckle member 20 as being squeezed into the notches 26 on two lateral sides to get fixed. It is worth mentioning that the string 30 could be detached from the notches 26. In more details, since the string 30 in the current embodiment is made of nylon, which is an elastic and deformable material, it could be pulled out from the notches 26 to disengage from the second buckle member 20.

Figure 4:
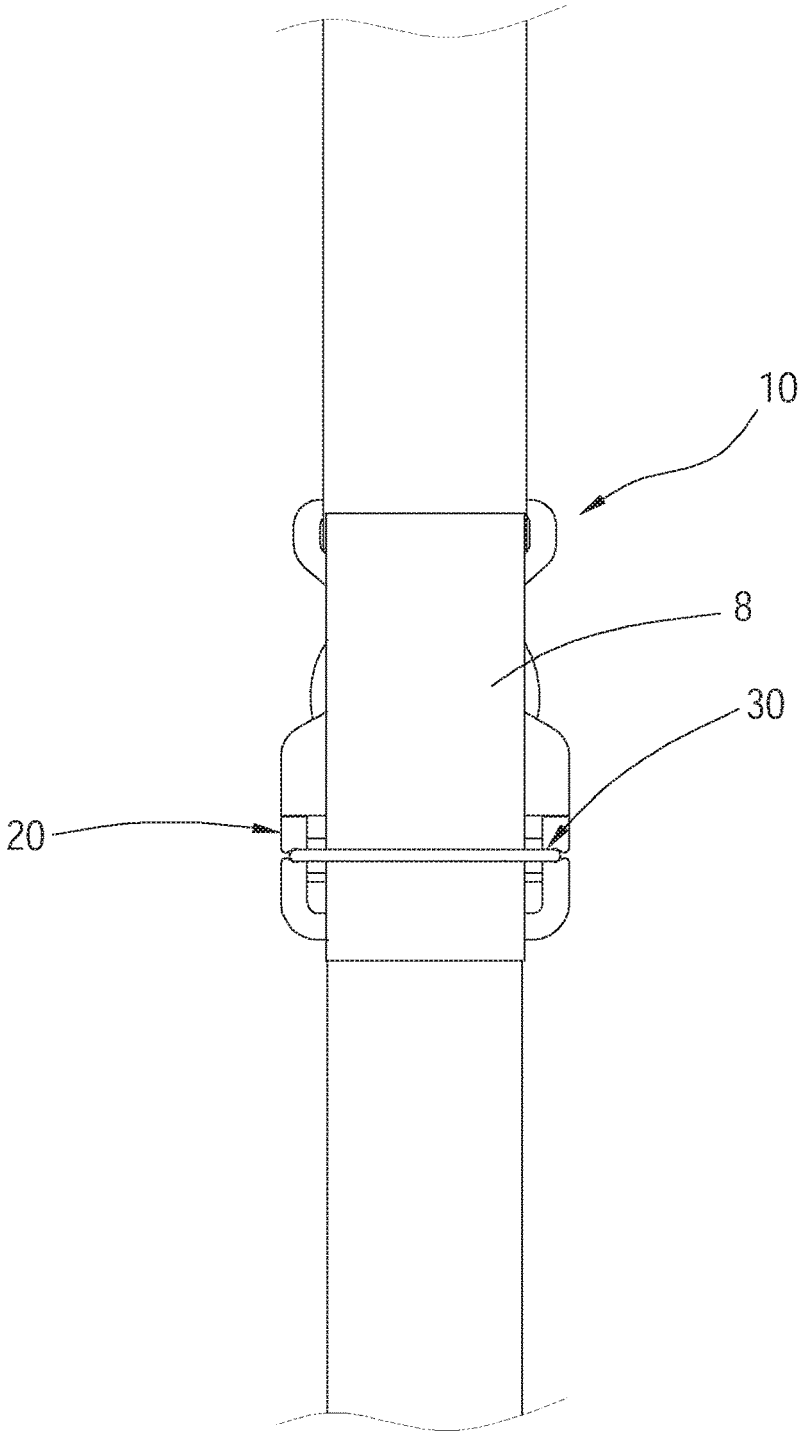
FIG. 4 is a schematic view, showing the strap is folded on the buckle.
Figure 5:
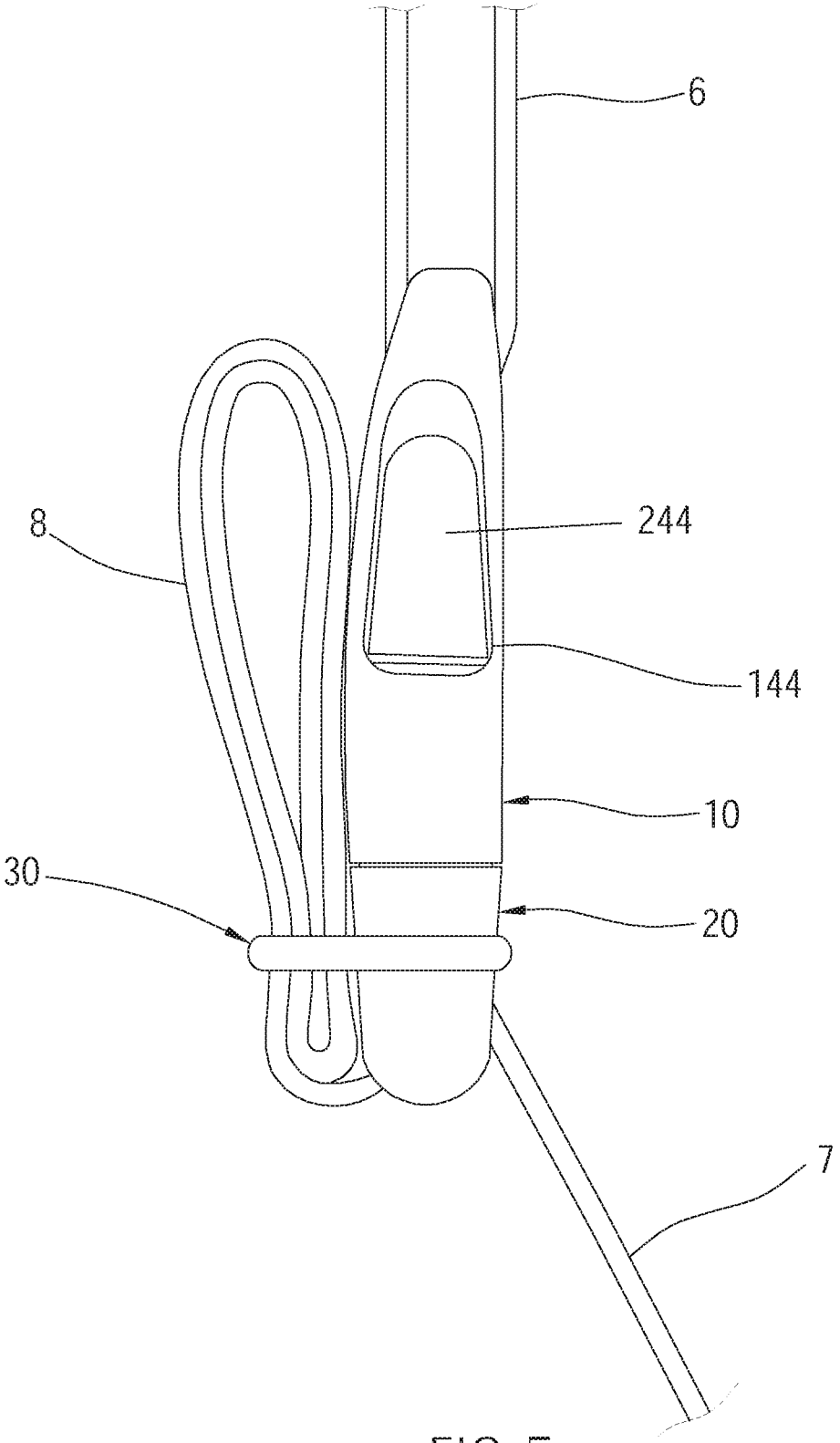
FIG. 5 is a side view of FIG. 4.

One of the methods of using the buckle 100 is illustrated in FIG. 3 to FIG. 5. For instance, the superfluous section 8 of the strap 7 could be folded in half several times on the surface of the second buckle member 20 in a long axial direction thereof, and then pass through a space between the string 30 and the second buckle member 20, whereby to fix the folded superfluous section 8 of the strap 7 on the second buckle member 20 through the string 30, preventing the superfluous section 8 from drooping or swinging. In this way, the superfluous section 8 (or can be called a free section) of the strap 7 extending out of the second buckle member 20 could be tidily fixed.

However, the way of folding the superfluous section 8 of the strap 7 is not a limitation of the present invention. In other embodiments, the superfluous section 8 could be rolled up in a direction or overlap itself, as long as the superfluous section 8 could be tightly fixed or attached to a surface of the second buckle member 20.

In the current embodiment, the first buckle member 10, which is the female buckle member, is detachably engaged with the second buckle member 20, which is the male buckle member. However, this is not a limitation of the present invention. In other embodiments, the first buckle member 10 could be a male buckle member, and the second buckle member 20 could be a female buckle member.

It is worth mentioning that, the structures of the first connecting portion 12 of said first buckle member 10 and the structures of the second connecting portion 22 of said second buckle member 20 are not limitations of the present invention. As long as the strap can be engaged with the first buckle member 10 and the second buckle member 20, whether movably or unmovably, the applied means should be considered equivalences of the first connecting portion 12 and the second connecting portion 22 disclosed in the present invention.

In addition, the opposite notches 26 could effectively confine the location of the string 30, whereby the string 30 would not disengage easily. However, the number of the notches is not limited to be two as exemplified above. There could be only one single notch provided, as long as the string 30 could be supported properly. Furthermore, the engaging portion is not necessary to be notches, but could be perforations which are adapted to be passed through by the string 30 in other embodiments.

Figure 6:
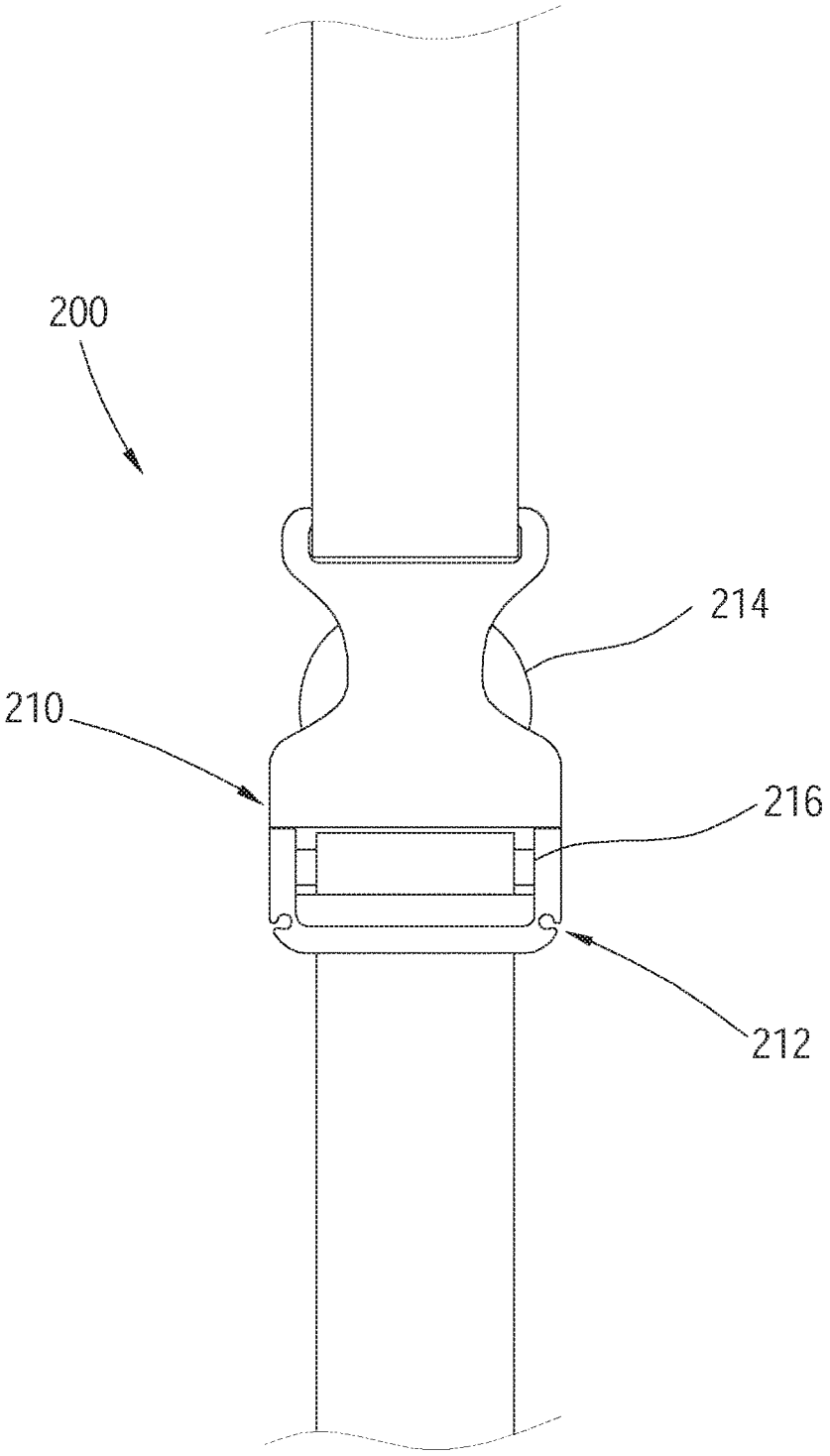
FIG. 6 is a schematic view of the buckle of a second embodiment of the present invention.

As illustrated in FIG. 6, a buckle 200 of a second embodiment of the present invention has almost the same structures as said buckle 100 of the first embodiment, except that an engaging portion 212 is located on a side of a second buckle member 210 opposite to a second buckling portion 214. Whereby, the second connecting portion 216 is located between the second buckling portion 214 and the engaging portion 212. More specifically, the engaging portion 212 includes two notches recessed into the side of the second buckle member 210 in a direction opposite to the second buckling portion 214. Preferably, the notches are located at two opposite positions on the side of the second buckle member 210.

Figure 7:
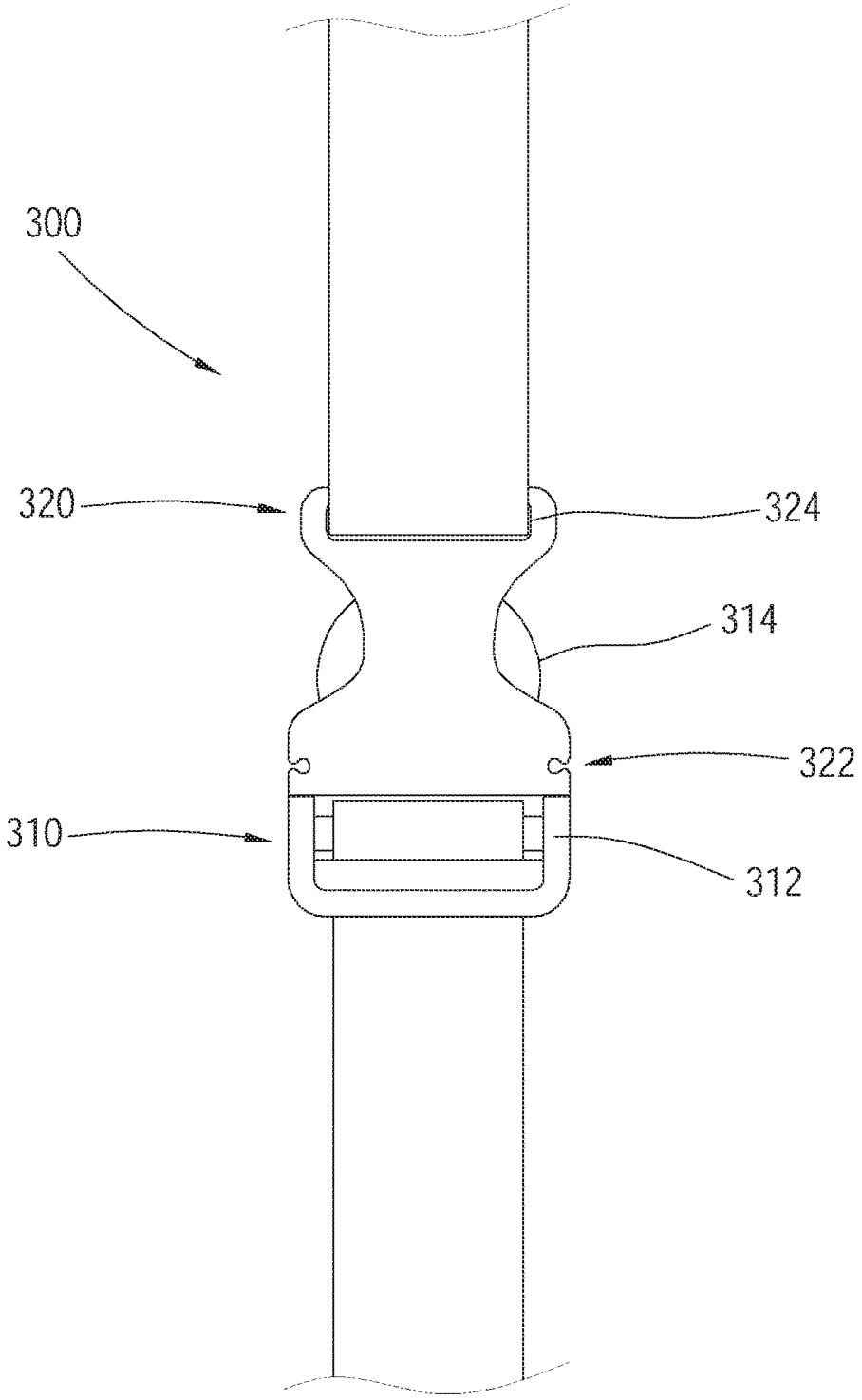
FIG. 7 is a schematic view of the buckle of a third embodiment of the present invention.

As illustrated in FIG. 7, a buckle 300 of a third embodiment of the present invention has almost the same structures as said buckle of the aforementioned embodiments, except that a first buckle member 310 is a male buckle member, and a second buckle member 320 is a female buckle member, wherein an engaging portion 322 of the second buckle member 320 is located on the second buckle member 320, and is away from a second connecting portion 324. Whereby, the engaging portion 322 would be located between a first connecting portion 312 of the first buckle member 310 and the second connecting portion 324 of the second buckle member 320 once the first buckle member 310 is engaged with the second buckle member 320. Alternatively, the engaging portion 322 could also be located between the first connecting portion 312 and a first buckling portion 314 after engaging the first buckle member 310 and the second buckle member 320.

Figure 8:
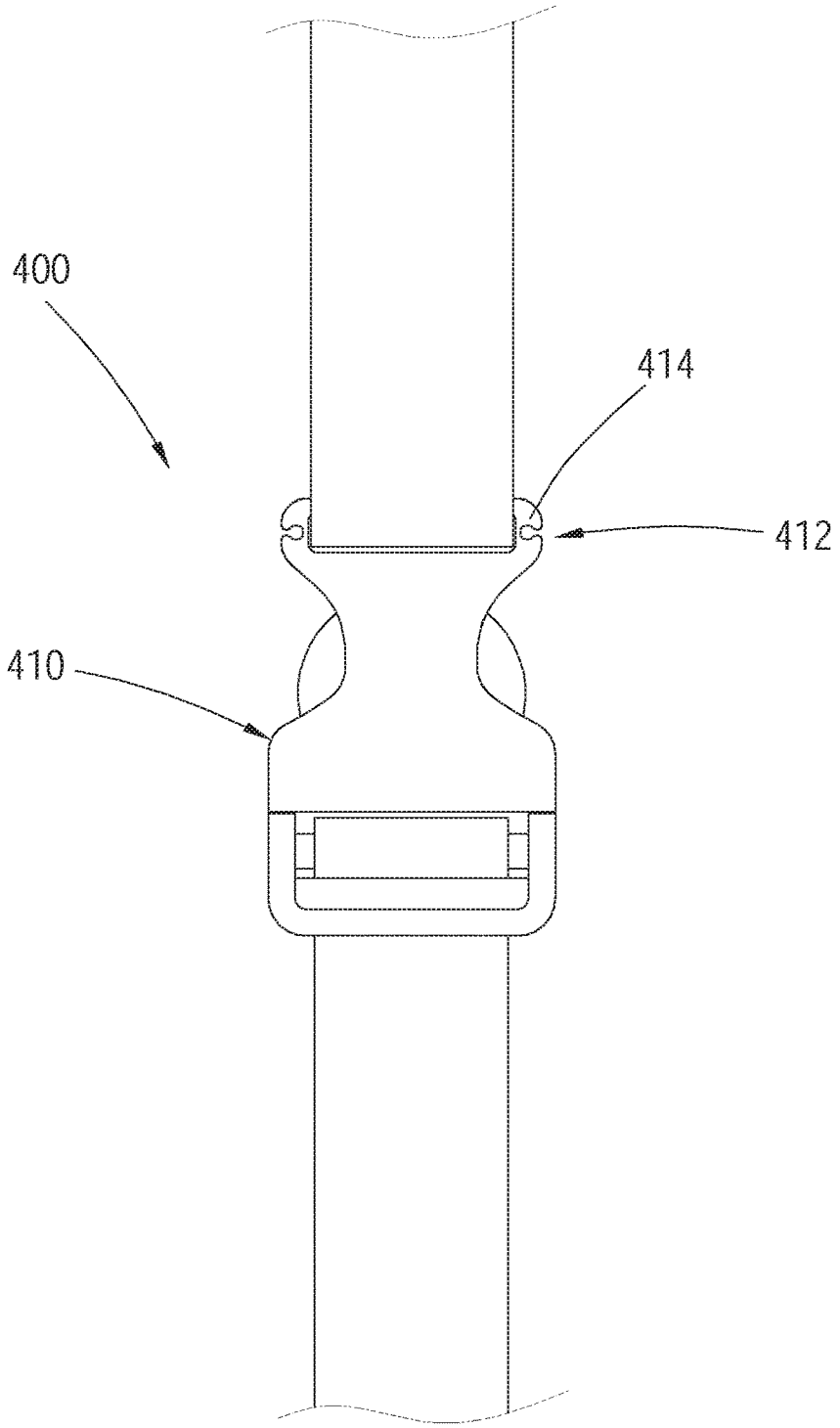
FIG. 8 is a schematic view of the buckle of a fourth embodiment of the present invention.

As illustrated in FIG. 8, a buckle 400 of a fourth embodiment of the present invention has almost the same structures as said buckle 300 of the third embodiment, except that an engaging portion 412 of a second buckle member 410 is located on the second buckle member 410 and is close to a second connecting portion 414. In more details, the second connecting portion 414 includes a slot, wherein the slot is adapted to be passed through by the strap 6. The engaging portion 412 includes two notches (or perforations) respectively located on two lateral sides of the slot. However, the structures of the engaging portion are not limitations of the present invention. In other embodiments, a notch or a perforation could be only provided on a single side of the slot.

Figure 9:
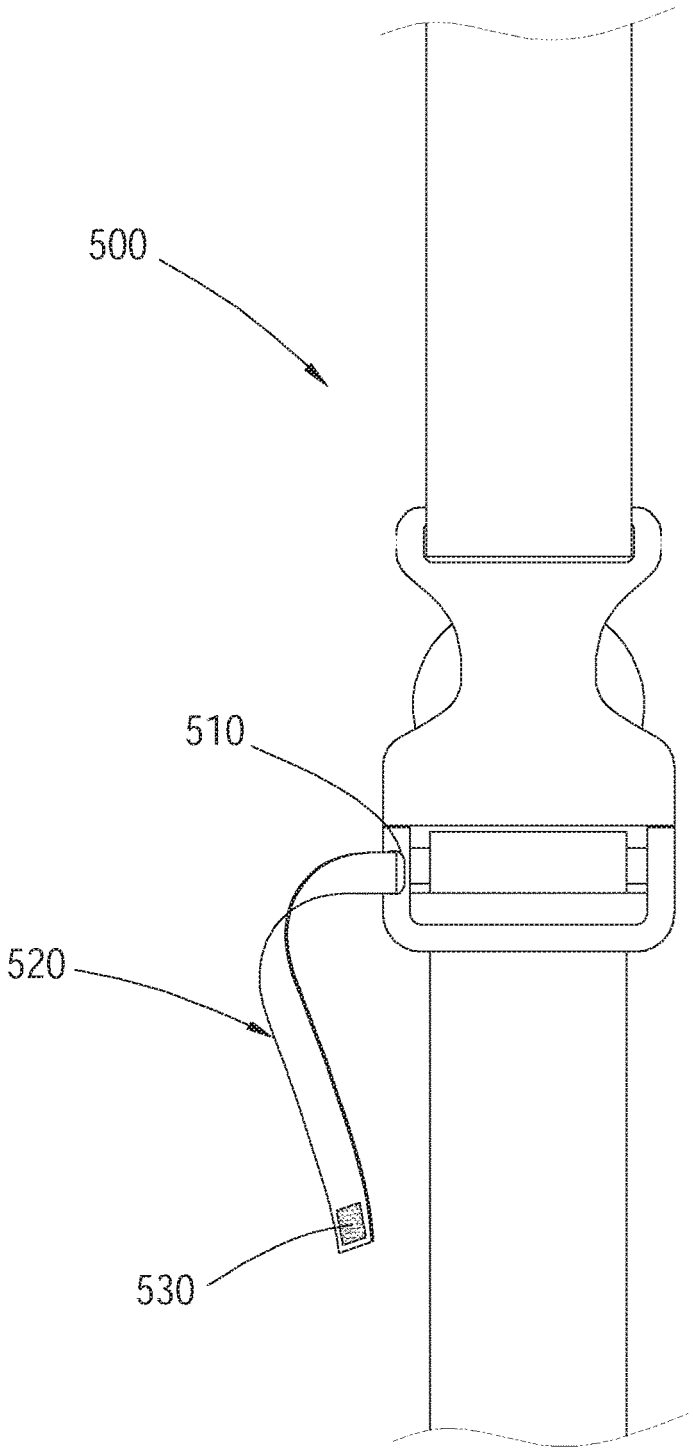
FIG. 9 is a schematic view of the buckle of a fifth embodiment of the present invention.

As illustrated in FIG. 9, a buckle 500 of a fifth embodiment of the present invention has almost the same structures as said buckle 100 of the first embodiment, except that an engaging portion of a second buckle member includes an engaging bore 510. A string 520 is substantially long in shape, wherein an end of the string 520 is engaged with the engaging bore 520, while another end thereof has a fastener 530 provided thereon, wherein the fastener 530 is either a hook component or a loop component in a hook-and-loop fastening mechanism. The string 520 is made of a material which could be attached to the fastener 530. Alternatively, an attached portion (not shown) could be provided on the first buckle member or the second buckle member, wherein the attached portion could be attached to the fastener 530. In other words, the material of the string 520 or the attached portion provided on the first buckle member or the second buckle member is complementary to the fastener 530, forming a hook-and-loop fastening relation. Whereby, after the superfluous section of the strap being folded on the first buckle member or the second buckle member, the folded strap could be winded by the string 520, and be fixed by attaching the fastener 530 at the end of the string 520 to itself or to the attached portion of the buckle. However, the use of the hook-and-loop fastening mechanism is not a limitation of the present invention. In other embodiments, the folded strap could be also fixed by engaging a male buckle member with a female buckle member. In other words, the spring 520 could have either a male buckle member or a female buckle member provided on one of the ends thereof, and the spring 520 or the buckle could be provided with a complementary buckle member.

In addition, said string is not limited to be a loop as exemplified above, but could be a cord or a plurality of cords (e.g., two cords) in other embodiments. Whereby, the folded strap could be fixed by being tied to one of the buckle members with the string.

Also, the engaging portion of each of the above embodiments is not limited to be a perforation or a notch, but could be a post adapted to be wound around by the string in other embodiments.

Also, in the aforementioned embodiments, the buckle is a snap-fit buckle or a side release buckle, wherein the first buckle member and the second buckle member are respectively a male buckle member and a female buckle member. However, this is not a limitation of the present invention. Any buckle with two detachable engaging components equivalent to the first buckle member and the second buckle member still falls within the scope of the present invention.

Also, the buckle disclosed in the present invention is not only adapted to connect the strap of a backpack, but could be also applied to connect waistbands, belts, shrink bands, seat belts, etc.

It is worth mentioning that, the first buckle member and the second buckle member are not limited to connect different straps. For instance, the first buckle member and the second buckle member could be provided on two free ends of the same strap, whereby the strap could form a circular ring by engaging the first buckle member and the second buckle member, wherein the superfluous section of the strap could be fixed on the buckle.

Figure 10:
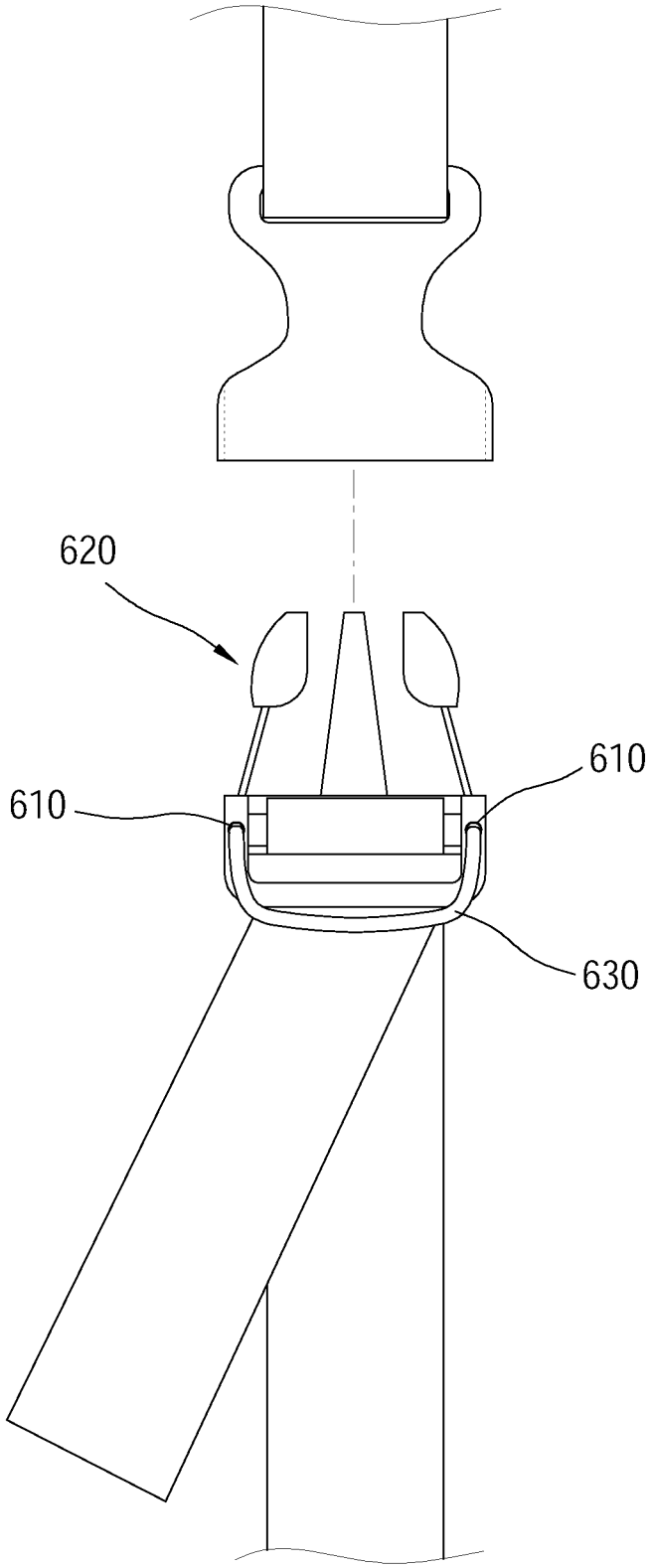
FIG. 10 is a schematic view of the buckle of another embodiment of the present invention.

It is noted that, the engaging portion of said embodiments is not limited to be notches, as long as the string could be engaged with the second buckle member. In other embodiments, said engaging portion could include at least one perforation. For instance, as shown in FIG. 10, each of the two lateral sides of the second buckle member 620 could be respectively provided with a perforation 610 holding a string 630, or a perforation could be provided only on one side of the second buckle member. In this way, said string could pass through the perforation(s) to be fixed on the second buckle member.

It must be pointed out that the embodiments described above are only some preferred embodiments of the present invention. All equivalent structures which employ the concepts disclosed in this specification and the appended claims should fall within the scope of the present invention.

What is claimed is:

1. A buckle, comprising:

a first buckle member having a first connecting portion and a first buckling portion, wherein the first connecting portion is adapted to be connected to a strap;

a second buckle member having a second connecting portion, a second buckling portion, and an engaging portion, wherein the second connecting portion is adapted to be connected to the strap or another strap, and the second buckling portion is adapted to be detachably engaged with the first buckling portion; and a string provided on the engaging portion, wherein the string is adapted to fix the strap or the another strap, which is folded;

wherein the engaging portion comprises at least one notch, and the string is provided in the at least one notch;

wherein a part of the strap or a part of the another strap has a superfluous section extending out of the first connecting portion or the second connecting portion, and the string is adapted to fix the superfluous section of the strap or the another strap which is folded.

2. The buckle of claim 1, wherein the second connecting portion is located between the second buckling portion and the engaging portion.

3. The buckle of claim 2, wherein the engaging portion comprises two notches recessed into a side of the second buckle member opposite to the second buckling portion.

4. The buckle of claim 1, wherein the engaging portion is located between the first connecting portion and the second connecting portion.

5. The buckle of claim 1, wherein the second connecting portion comprises a slot; the slot is adapted to be passed through by the strap; the engaging portion is located on two lateral sides of the slot.

6. The buckle of claim 1, wherein the string is a loop.

7. The buckle of claim 1, wherein the second connecting portion comprises two slots and a bar; the slots are provided in parallel, and the bar is located between the slots; the engaging portion is located on at least one end of the bar.

8. A buckle, comprising:

a first buckle member having a first connecting portion and a first buckling portion, wherein the first connecting portion is adapted to be connected to a strap;

a second buckle member having a second connecting portion, a second buckling portion, and an engaging portion, wherein the second connecting portion is adapted to be connected to the strap or another strap, and the second buckling portion is adapted to be detachably engaged with the first buckling portion; and a string provided on the engaging portion, wherein the string is adapted to fix the strap or the another strap, which is folded;

wherein the engaging portion comprises at least one perforation, and the string is provided in the at least one perforation;

wherein a part of the strap or a part of the another strap has a superfluous section extending out of the first connecting portion or the second connecting portion, and the string is adapted to fix the superfluous section of the strap or the another strap which is folded.

9. The buckle of claim 8, wherein an end of the string is engaged with the engaging portion, and another end of the string is fixed on the second buckle member or on the string itself after the string winding around the folded strap.

* * * * *